US007357064B2

(12) United States Patent
Kauss

(10) Patent No.: US 7,357,064 B2
(45) Date of Patent: Apr. 15, 2008

(54) HYDRAULIC CONTROL SYSTEM FOR A MOBILE PIECE OF EQUIPMENT

(75) Inventor: Wolfgang Kauss, Francheville (FR)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/576,709

(22) PCT Filed: Nov. 22, 2004

(86) PCT No.: PCT/DE2004/002576

§ 371 (c)(1),
(2), (4) Date: May 25, 2006

(87) PCT Pub. No.: WO2005/052266

PCT Pub. Date: Jun. 9, 2005

(65) Prior Publication Data

US 2007/0056440 A1 Mar. 15, 2007

(30) Foreign Application Priority Data

Nov. 25, 2003 (DE) ..... 103 54 957

(51) Int. Cl.
*F15B 13/02* (2006.01)

(52) U.S. Cl. ..... 91/515; 91/511

(58) Field of Classification Search ..... 91/511, 91/512, 515; 414/700
See application file for complete search history.

(56) References Cited

U.S. PATENT DOCUMENTS

| | | | | |
|---|---|---|---|---|
| 3,642,159 | A | 2/1972 | Askins | |
| 5,083,894 | A | 1/1992 | Ikari et al. | |
| 5,356,260 | A | 10/1994 | Ikari et al. | |
| 5,669,282 | A * | 9/1997 | Tanino et al. | 414/700 |
| 5,797,310 | A * | 8/1998 | Casey et al. | 91/515 |
| 6,389,953 | B1 * | 5/2002 | Altman et al. | 91/515 |
| 6,561,751 | B1 | 5/2003 | Ishizaki et al. | |
| 6,898,932 | B2 * | 5/2005 | Kajita | 60/424 |
| 7,059,237 | B2 * | 6/2006 | Ioku et al. | 91/515 |
| 7,127,888 | B2 * | 10/2006 | Kajita et al. | 60/424 |

FOREIGN PATENT DOCUMENTS

| | | |
|---|---|---|
| DE | 195 81 883 T1 | 12/1997 |
| DE | 103 34 321 A1 | 7/2004 |
| JP | A 1-182419 | 7/1989 |

* cited by examiner

*Primary Examiner*—Michael Leslie
(74) *Attorney, Agent, or Firm*—Oliff & Berridge, PLC

(57) ABSTRACT

What is disclosed is a control arrangement for an equipment, in particular a wheel loader or a backhoe loader having a shovel mounted articulatedly at a boom, wherein the control arrangement enables a control of the shovel by means of a control pressure of a boom control unit, so that the latter may be taken into a target position during lowering of the boom or while the boom is taken into a floating condition.

10 Claims, 2 Drawing Sheets

HYDRAULIC CONTROL SYSTEM FOR A MOBILE PIECE OF EQUIPMENT

Figure 1:
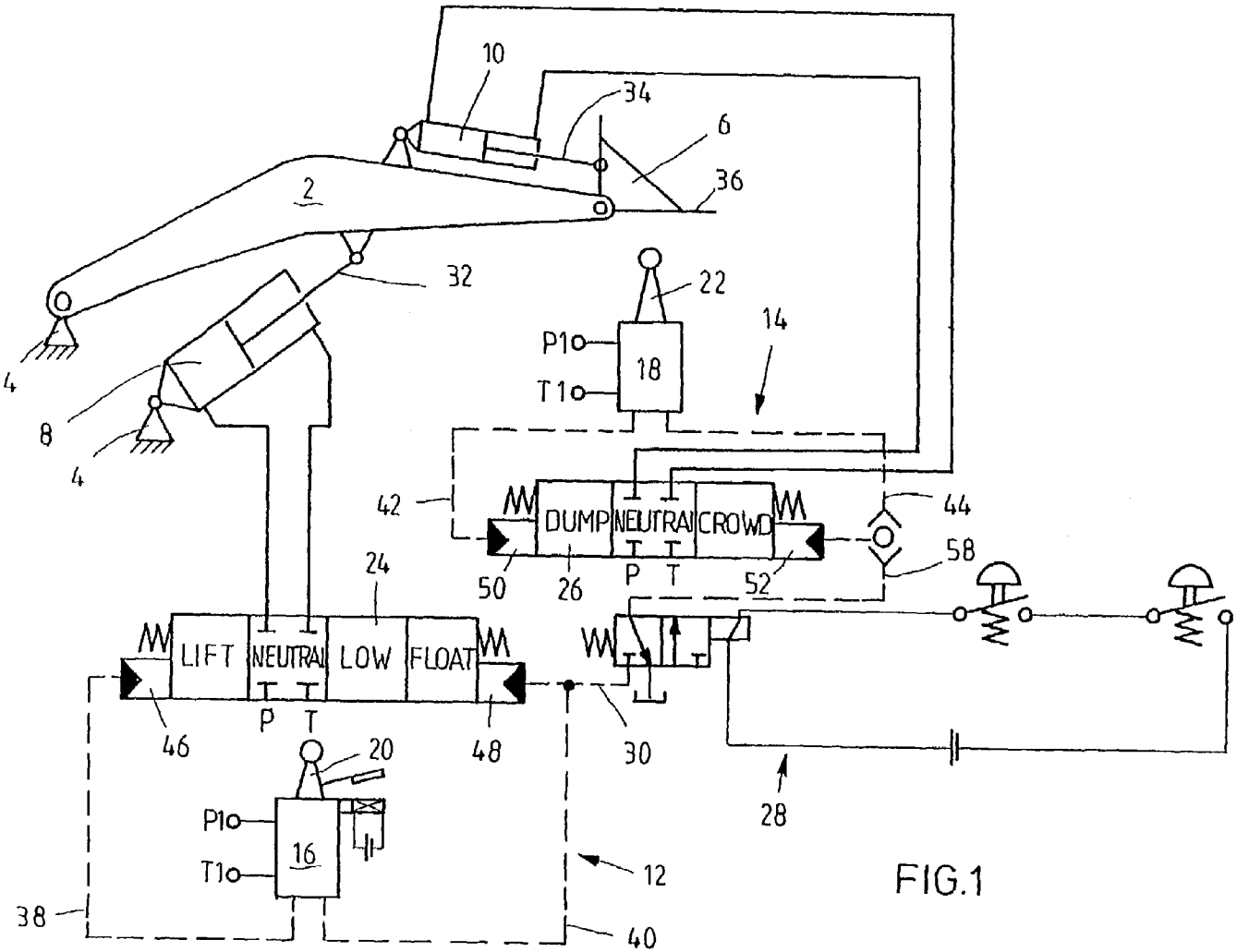

Hydraulic control system for a mobile piece of equipment The invention concerns a control arrangement for a mobile equipment, in particular a wheel loader or a backhoe loader, in accordance with the preamble of claim 1.

In wheel loaders or backhoe loaders a boom is pivotally linked to a frame. The boom may be pivoted by means of a boom cylinder that is supported on the frame. At the end portion of the boom opposite the frame a shovel is mounted which is pivotable through the intermediary of a shovel cylinder. Both cylinders have the form of a differential cylinder and are each connected, for retracting and extending, via a respective pilot control device having an associated proportional valve with a variable displacement pump or with a tank.

In order to lower the boom or for taking the boom into a floating condition in which the shovel rests on the ground for levelling, in a known solution the boom and the shovel must each be controlled separately by operation of a control lever of their pilot control devices. Herein the control levers of the pilot control devices are locked in their end positions, so that the shovel assumes a predetermined relative orientation.

It is a drawback in this solution that the driver has to operate both pilot control devices in order to effect locking or in order to release for again raising the boom. Moreover it is a drawback that both control levers have to be executed with locking mechanisms.

It is an object of the invention to furnish a control arrangement for an equipment, in particular a wheel loader or a backhoe loader, which allows for simplified control of the shovel for taking it into its target position.

This object is achieved through a control arrangement having the features in accordance with claim 1.

In accordance with the invention, the control arrangement comprises a valve arrangement which is connected with a control line of a boom control unit and with a signal line of a shovel control unit, so that the shovel may be taken into a target position with the aid of a control pressure of the boom control unit acting in the direction of lowering the boom.

By means of the valve arrangement it is thus possible to pass the control pressure for lowering the boom on to the shovel control unit, so that a pilot control device of the shovel control unit need not be operated manually. Actuation of a proportional valve of the shovel control unit then takes place with the aid of the control pressure output by the boom control unit. Therefore a control lever of the pilot control device of the shovel control unit remains in its neutral position while not being locked in its corresponding end position.

By means of a shuttle valve the higher one of the control pressures in the signal line or in the control line is conducted to the proportional valve of the shovel control unit. The shuttle valve has two inlets for connection of the signal line and of the control line and an outlet communicating with a control chamber of the proportional valve of the shovel control unit.

In a preferred embodiment, the valve arrangement comprises a switching valve spring-biased in the basic position. By means of a switching solenoid which may be energized through an activation switch in an electric circuit, the switching valve may be taken into a switching position.

Advantageously a position switch is arranged in the electric circuit for interrupting the latter as soon as the shovel has assumed its target position. By this interruption the switching valve is again returned into its basic position, so that the control pressure of the boom control unit acting in the direction of lowering is no more passed on to the shovel control unit.

In one embodiment, an end position locking mechanism for locking a control lever of the pilot control device of the boom control unit in its end positions is provided.

Further advantageous embodiments are subject matter of further subclaims.

Figure 2:
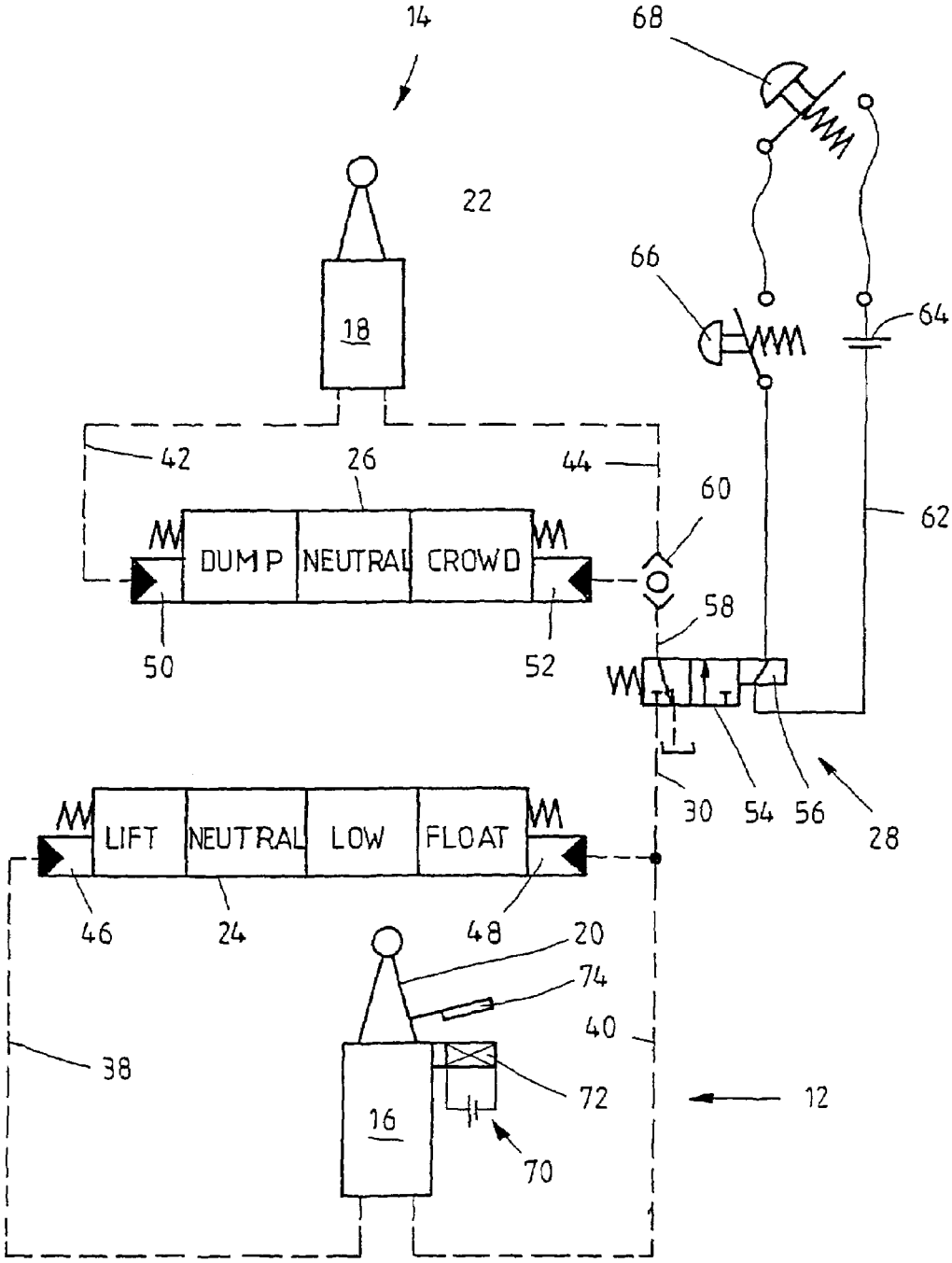

In the following, a detailed explanation of a preferred embodiment shall be given by referring to schematic representations, wherein:

FIG. 1 is a diagram of a control arrangement in accordance with the invention with its equipment represented in a simplified form, and FIG. 2 is a single view of the control arrangement in accordance with the invention of FIG. 1.

FIG. 1 shows a diagram of a control arrangement of a mobile equipment, e.g., of a wheel loader or of a backhoe loader. The latter comprises a boom 2 articulatedly mounted by an end portion thereof on a frame 4. At the end portion of the boom 2 opposite the frame 4, a shovel 6 is mounted pivotally. The boom 2 and the shovel 6 are adapted to be pivoted with the aid of a boom cylinder 8 or a shovel cylinder 10, respectively. The boom cylinder 8 is supported at the frame 4 and attacks with a piston rod 32 at the boom 2. The shovel cylinder 10 is supported at the boom 2 and attacks with a piston rod 34 at the shovel 6. Both cylinders 8, 10 have the form of a double-acting cylinder.

The pressure medium supply of the cylinders 8, 10 takes place via a respective control unit 12, 14. The control units 12, 14 are of a similar construction and each comprise one pilot control device 16, 18 having a control lever 20, 22 connected, via control lines 38, 40 and signal lines 42, 44, respectively, with control chambers 46, 48 and 50, 52 of a proportional valve 24, 26. The proportional valves 24, 26 are spring-biased in the direction of a neutral position in which all the ports of the control units 12, 14 are blocked relative to a feed pump or a tank. By operating the control levers 20, 22 a control oil pressure furnished by a control oil pump, reduced to a control pressure, is conducted to the proportional valves 24, 26 which are shifted from their neutral positions in correspondence with the operation of the control levers, whereby the boom 2 or the shovel 6 are controlled correspondingly.

The cylinders 8, 10, control units 12, 14, pilot control devices 16, 18, control levers 20, 22 and proportional valves 24, 26 shall hereinafter be referred to, in accordance with their association to boom or shovel, as boom cylinder 8, shovel cylinder 10, boom control unit 12, shovel control unit 14, boom pilot control device 16, shovel pilot control device 18, boom control lever 20, shovel control lever 22, boom proportional valve 24 and shovel proportional valve 26.

The boom proportional valve 24 may assume four positions for moving the boom 2 into a corresponding operating state. The possible positions are lifting (Lift), lowering (Low), floating (Float) and holding (Neutral). In the lifting position, the piston rod 32 of the boom cylinder 8 extends, and the boom 2 is pivoted in a counter clockwise sense. In the lowering position, the piston rod 32 is retracted and the boom 2 is pivoted in a clockwise direction. In the floating position the piston rod 32 is equally retracted, however the pressure chambers of the boom cylinder 8 are connected to the tank, so that the boom 2 is taken into a floating condition in which is rests on the ground, as it were, in a freely swinging condition. Such a floating condition of the boom 2 is adjusted, e.g., for levelling the ground, wherein the shovel is dragged or pushed across the ground while the equipment is travelling, whereby ground irregularities may be removed. In the neutral position, the boom 2 may be held in a particular relative orientation with the frame 4.

The shovel proportional valve 24 may assume three positions for moving the shovel 6 into a corresponding operating state. The possible positions are tilting (Dump), picking up (Crowd) and holding (Neutral). In the tilting position, the piston rod 34 of the shovel cylinder 10 is extended, so that the shovel 6 executes a pivoting movement in a clockwise direction and may dump picked-up objects. In the picking up position, the piston rod 34 is retracted, so that the shovel executes a pivoting movement in a counter clockwise direction and may pick up objects. In the neutral position, the shovel 6 may be held in a particular relative orientation with the boom 2.

During the floating condition of the boom 2, the shovel 6 is preferably taken into a target position wherein it is inclined in a particular angular position relative to the boom 6. In this target position the shovel edge 36 of the shovel 6 is spaced apart from the ground so as to avoid tearing open the ground. This target position thus predominantly corresponds to a position of the shovel 6 in which it is pivoted inwards in a counter clockwise direction.

The boom control unit 12 and the shovel control unit 14 communicate via a valve arrangement 28 in accordance with the invention, so that a control signal of the boom control unit 12 acting in the direction of lowering may be conducted to the shovel proportional valve 26.

In accordance with FIG. 2 the valve arrangement 28 has a switching valve 54 arranged between a boom connecting line 30 and a shovel connecting line 58. The boom connecting line 30 is on the other hand connected with the control line 40 acting in the direction of lowering the boom 2. The shovel connecting line 58 extends in the direction of the signal line 44 which acts in the direction of the target position of the shovel 6. The shovel connecting line 58 and the signal line 44 are connected to inlets of a shuttle valve 60, the outlet of which communicates with the control chamber 52.

In the spring-biased basic position of the switching valve 54 the two connecting lines 30, 58 are blocked relative to each other, so that no control pressure may be conducted from the boom control unit 12 to the shovel control unit 14, wherein the shovel connecting line 58 is connected with the tank.

In order to take the switching valve 54 into its switching position in which the control pressure in the control line 40 may act via the shuttle valve 60 on the shovel proportional valve 26, the valve arrangement 28 moreover includes an electric circuit 62 through which a switching solenoid 56 of the switching valve 54 may be energized. In the electric circuit 62 a current source 64, an activation switch 66 and a position transmitter 68 are arranged. The activation switch 66 and the position transmitter 68 are spring-biased in the direction of opening and arranged in series, so that the switching solenoid 54 can be energized and the spring force of the biasing spring of the switching valve 54 can be overcome only if the activation switch 66 and the position transmitter 68 are closed and activated, respectively, at a same time.

The activation switch 66 is operated by the driver when the shovel 6 is to be taken into its target position. Preferably it is designed such that it returns from the closed actuation position caused by the driver into its open position as soon as the electric circuit 64 is interrupted. Manual resetting of the activation switch 66 is, however, equally conceivable.

The position transmitter 68 is actuated indirectly or directly by the shovel 6 depending on the current pivoting condition or relative orientation with the boom 6. It remains closed until the shovel 6 has assumed its target position. Once the target position has been reached, the position transmitter 68 opens, and the electric circuit 62 is interrupted. The electric circuit 62 is closed again when the shovel 6 moves out of this target position.

FIG. 2 further shows that the boom pilot control device 12 has an end position locking mechanism 70 comprising a solenoid 72 and a retaining member 74. When the boom control lever 20 is taken into one of its end positions, the retaining member 74 is retained at the solenoid 72 by a magnetic force, so that the boom control lever 20 is positionally secured. Releasing may be performed automatically by de-energization of the solenoid 72.

In the following the operation of this control arrangement in accordance with the invention shall be explained.

It shall be assumed that the shovel 6 is not in its target position. The position transmitter 68 is closed. Accordingly the electric circuit 62 is interrupted, and the switching valve 54 is in its basic position wherein the two connecting lines 30, 58 are blocked relative to each other, and accordingly no connection between the boom control unit 12 and the shovel control unit 14 being established.

If, now, the boom 2 is to be taken into its floating condition, the shovel 6 must be taken into its corresponding target position. This means that the shovel 6 must be pivoted inwards in a counter clockwise direction, so that upon contact between ground and shovel 6, the shovel edge 36 is at a distance from the ground and the shovel 2 is prevented from digging in.

The driver operates the activation switch 66 and the electric circuit 62 is closed, so that the switching solenoid 56 is energized and the switching valve 54 is taken from its basic position into its switching position. The boom connecting line 30 and the shovel connecting line 58 are connected with each other, and a control pressure of the boom control unit 12 acting in the direction of lowering may be conducted to the shovel proportional valve 26.

This control pressure is generated by the driver through a corresponding pivoting movement of the boom control lever 20. In accordance with this pivoting movement of the boom control lever 20, a hydraulic control signal is generated by the boom pilot control device 16, so that the control chambers 46, 48 are subjected to a corresponding control pressure difference. As a result of this control pressure difference, the boom proportional valve 24 is taken from its neutral position into its right-hand position, so that the boom 2 is pivoted in a clockwise direction and taken into its floating condition. Here the boom control lever 20 is locked in its end position by the end position locking mechanism 70. Concurrently this control pressure is conducted via the connecting lines 30, 58 and the shuttle valve 60 into the control chamber 52 of the shovel proportional valve 26, so that between the control chambers 50, 52 a control pressure difference is generated whereby the shovel proportional valve 26 is moved to the left into its picking up position. The shovel control lever 22 remains inactive during the entire process.

Once the shovel 6 has assumed its target position, the position transmitter 68 opens, and the electric circuit 62 is interrupted. The switching solenoid 56 is not energized any more, and the switching valve 54 is moved back by the spring force of its biasing spring into its basic position in which the connecting lines 30, 58 are again blocked relative to each other. In addition, owing to the interruption of the electric circuit 62 the activation switch 66 opens again or is reset manually by the driver, respectively. Due to the switching valve 54 being reset into its basic position, the control pressure of the boom control unit 12 acting in the direction inward pivoting of the shovel 6 cannot be conducted to the shovel proportional valve 26 any more. The control chamber 52 previously subjected to the control pressure is relieved of pressure via the shovel connecting line 58, the shuttle valve 60 and the switching valve 54 towards the tank, and thus the control pressure difference between the control chambers 50, 52 is removed, so that the shovel proportional valve 26 resumes its spring-biased neutral position.

Hereby the shovel 6 is taken into its target position.

In order to move the shovel 6 from this target position into a tilting condition, i.e., in order to outwardly pivot the shovel 6 in a clockwise direction, the driver operates the shovel control lever 22 such that the shovel pilot control device 18 generates a control signal, so that the control chambers 50, 52 of the shovel proportional valve 26 are subjected to a control pressure difference and the latter is shifted from its neutral position to the right. As soon as the shovel 6 leaves its target position, the position transmitter 68 is closed automatically, so that the above described process may, in a sense, start anew.

Even if shifting of the shovel 6 into its target position is described relative to the floating condition of the boom 2, the functional principle is also applicable relative to a general lowering movement of the boom 2. In general it may be said that as a result of the control arrangement in accordance with the invention, a control signal of the boom control unit 12 acting in the direction of a lowering movement of the boom 2 is passed on to the shovel control unit 14, so that the shovel 6 is taken into a corresponding target position.

What is disclosed is a control arrangement for an equipment, in particular a wheel loader or a backhoe loader having a shovel mounted articulatedly at a boom, wherein the control arrangement enables a control of the shovel by means of a control pressure of a boom control unit, so that the latter may be taken into a target position during lowering of the boom or while the boom is taken into a floating condition.

LIST OF REFERENCE SYMBOLS

2 boom
4 frame
6 shovel
8 boom cylinder
10 shovel cylinder
12 boom control unit
14 shovel control unit
16 boom pilot control device
18 shovel pilot control device
20 boom control lever
22 shovel control lever
24 boom proportional valve
26 shovel proportional valve
28 valve arrangement
30 boom connecting line
32 boom piston rod
34 shovel piston rod
36 shovel edge
38 control line
40 control line
42 signal line
44 signal line
46 control chamber
48 control chamber
50 control chamber
52 control chamber
54 switching valve
56 switching solenoid
58 shovel connecting line
60 shuttle valve
62 electric circuit
64 current source
66 activation switch
68 position transmitter
70 end position locking mechanism
72 solenoids
74 retaining member

The invention claimed is:

1. A control arrangement for mobile equipment comprising:

a boom pivotable by means of a boom cylinder;

a shovel pivotally mounted at the boom by means of a shovel cylinder, each of the boom and the shovel including a control unit having a pilot control device and a proportional valve for controlling the boom cylinder and the shovel cylinder; and a valve arrangement, whereby during lowering of the boom, a control line of the boom control unit acting in the direction of lowering may be connected with a signal line of the shovel control unit, so that the shovel may be taken into a target position with respect to the boom by means of the control pressure tapped at the boom control unit, wherein the valve arrangement is arranged between a boom connecting line connected with the control line and a shovel connecting line connected with an inlet of a shuttle valve, and wherein the shuttle valve is connected by another inlet with the signal line and by its outlet with a control chamber of the shovel proportional valve.

2. The control arrangement in accordance with claim 1, wherein the valve arrangement includes a switching valve which is spring-biased in its basic position and has a switching solenoid which may be energized by means of an activation switch in an electric circuit.

3. The control arrangement in accordance with claim 2, wherein a boom control lever of the boom pilot control device of the boom control unit is adapted to be locked in its end positions.

4. The control arrangement in accordance with claim 1, wherein a boom control lever of the boom pilot control device of the boom control unit is adapted to be locked in its end positions.

5. The control arrangement in accordance with claim 1, wherein the mobile equipment is a wheel loader or a backhoe loader.

6. A control arrangement for mobile equipment comprising:

a boom pivotable by means of a boom cylinder;

a shovel pivotally mounted at the boom by means of a shovel cylinder, each of the boom and the shovel including a control unit having a pilot control device and a proportional valve for controlling the boom cylinder and the shovel cylinder; and a valve arrangement, whereby during lowering of the boom, a control line of the boom control unit acting in the direction of lowering may be connected with a signal line of the shovel control unit, so that the shovel may be taken into a target position with respect to the boom by means of the control pressure tapped at the boom control unit, and wherein the valve arrangement includes a switching valve which is spring-biased in its basic position and has a switching solenoid which may be energized by means of an activation switch in an electric circuit.

7. The control arrangement in accordance with claim 6, wherein a position transmitter is arranged in the electric circuit which interrupts the latter as soon as the target position of the shovel is reached.

8. The control arrangement in accordance with claim 7, wherein a boom control lever of the boom pilot control device of the boom control unit is adapted to be locked in its end positions.

9. The control arrangement in accordance with claim 6, wherein a boom control lever of the boom pilot control device of the boom control unit is adapted to be locked in its end positions.

10. A control arrangement for mobile equipment comprising:

a boom pivotable by means of a boom cylinder:

a shovel pivotally mounted at the boom by means of a shovel cylinder; each of the boom and the shovel including a control unit having a pilot control device and a proportional valve for controlling the boom cylinder and the shovel cylinder: and a valve arrangement, whereby during lowering of the boom, a control line of the boom control unit acting in the direction of lowering may be connected with a signal line of the shovel control unit, so that the shovel may be taken into a target position with respect to the boom by means of the control pressure tapped at the boom control unit, and wherein a boom control lever of the boom pilot control device of the boom control unit is adapted to be locked in its end positions.

* * * * *